US010794672B2

(12) United States Patent
Oman

(10) Patent No.: US 10,794,672 B2
(45) Date of Patent: Oct. 6, 2020

(54) LIGHTED NOCK

(71) Applicant: GSM, LLC, Houston, TX (US)

(72) Inventor: Jason Oman, Henderson, NV (US)

(73) Assignee: GSM, LLC, Houston, TX (US)

( * ) Notice: Subject to any disclaimer, the term of this patent is extended or adjusted under 35 U.S.C. 154(b) by 0 days.

(21) Appl. No.: 16/295,161

(22) Filed: Mar. 7, 2019

(65) Prior Publication Data

US 2020/0284561 A1 Sep. 10, 2020

(51) Int. Cl.
*F42B 6/06* (2006.01)
*F21V 23/04* (2006.01)
*F21V 33/00* (2006.01)

(52) U.S. Cl.
CPC ..... *F42B 6/06* (2013.01); *F21V 23/04* (2013.01); *F21V 33/008* (2013.01)

(58) Field of Classification Search
CPC ..... F42B 6/06; F42B 12/38; F42B 12/42
USPC ..... 473/570, 578
See application file for complete search history.

(56) References Cited

U.S. PATENT DOCUMENTS 6,123,631 A * 9/2000 Ginder ..... F42B 6/06 473/570
6,213,114 B1 * 4/2001 Burkhart ..... F42B 6/06 124/91
7,927,240 B2 * 4/2011 Lynch ..... F42B 6/06 473/570
7,931,550 B2 * 4/2011 Lynch ..... F42B 6/06 473/570
7,993,224 B2 * 8/2011 Brywig ..... F42B 6/06 473/570
8,758,177 B2 * 6/2014 Minica ..... F42B 6/06 473/586
8,777,786 B1 * 7/2014 Bay ..... F42B 12/42 473/578
9,243,875 B2 * 1/2016 Minica ..... F42B 6/06
9,279,648 B2 3/2016 Marshall, Jr.
9,279,649 B2 * 3/2016 Bay ..... F42B 12/362
9,546,851 B2 * 1/2017 Kim ..... F42B 6/06
9,568,290 B2 2/2017 Marshall, Jr.
9,677,859 B1 * 6/2017 Kim ..... F42B 12/382
9,702,671 B2 * 7/2017 Minica ..... F42B 6/06
9,702,672 B1 * 7/2017 Kim ..... F42B 6/06
9,733,051 B2 * 8/2017 Bay ..... F42B 12/362
9,897,423 B2 * 2/2018 Bay ..... F21S 10/023
10,001,353 B1 * 6/2018 Godsey ..... F42B 6/06
10,094,642 B1 * 10/2018 Godsey ..... F42B 6/06
10,139,205 B2 * 11/2018 Yehle ..... F42B 6/06
10,161,728 B2 * 12/2018 Bay ..... F42B 6/06
10,203,186 B2 * 2/2019 Yehle ..... F42B 6/06
10,203,187 B1 * 2/2019 Bay ..... F42B 6/06
(Continued)

*Primary Examiner* — Alexander R Niconovich
(74) *Attorney, Agent, or Firm* — Pauley Erickson & Swanson

(57) ABSTRACT

A lighted nock and a method for operating the lighted nock. A nock body has a shaft extending from the nock body. The nock body can form a nock cavity and a light source can be positioned within the nock cavity. A ferrule can form a ferrule cavity. A power source can be at least partially housed within the ferrule cavity and at least partially housed within the nock cavity. The shaft can at least partially be mounted within the ferrule cavity. A bias element can be mounted between the light source and the power source. The lighted nock can be switched between an on condition and an off condition.

20 Claims, 4 Drawing Sheets

(56) References Cited

U.S. PATENT DOCUMENTS

| | | | | |
|---|---|---|---|---|
| 10,254,095 | B1 * | 4/2019 | Wang | F42B 6/06 |
| 10,429,157 | B2 * | 10/2019 | Bay | F42B 12/42 |
| 2009/0097239 | A1 * | 4/2009 | Lynch | F42B 6/06 362/202 |
| 2009/0098959 | A1 * | 4/2009 | Lynch | F21V 33/008 473/570 |
| 2009/0139508 | A1 | 6/2009 | Harwath et al. | |
| 2012/0100942 | A1 * | 4/2012 | Minica | F42B 6/06 473/570 |
| 2014/0121045 | A1 * | 5/2014 | Minica | F42B 6/06 473/570 |
| 2014/0148283 | A1 * | 5/2014 | Marshall, Jr. | F42B 6/06 473/570 |
| 2015/0018141 | A1 * | 1/2015 | Bay | F42B 12/362 473/570 |
| 2015/0105191 | A1 * | 4/2015 | Pedersen | F42B 6/02 473/570 |
| 2016/0097617 | A1 * | 4/2016 | Minica | F42B 6/06 473/570 |
| 2018/0231359 | A1 * | 8/2018 | Yehle | F42B 12/42 |

* cited by examiner

LIGHTED NOCK

BACKGROUND OF THE INVENTION

Field of the Invention

This invention relates to a lighted nock apparatus and a method for using the lighted nock apparatus.

Discussion of Related Art

Many conventional lighted nock assemblies allow hunters or other users to switch a light source between an on condition to provide light and an off condition to provide no light. Conventional lighted nock assemblies allow the user to shine light through the nock structure to provide a lit environment surrounding the nock structure, which can help to see the surrounding environment. Conventional lighted nock assemblies can also be used to allow a hunter to track or find a discharged arrow. The light can provide guidance when tracking a discharged arrow.

Conventional lighted nock assemblies can be switched between the on condition and the off condition, which can help to conserve batteries or other power sources. Hunters use many conventional lighted nock assemblies in a normally off condition of the light source. Hunters are often concerned with eliminating or at least minimizing noise that would scare away or spook prey, particularly animals with very sensitive hearing capabilities.

SUMMARY OF THE INVENTION

According to this invention, a lighted nock or nock assembly can be operated between an on condition when the lighted nock is lit and emits light and an off condition when the lighted nock is not lit and emits no light. Hunters and other users of the lighted nock of this invention can conserve power by simply and effortlessly switching the lighted nock of this invention to the off condition when power is not needed and then just as simply and effortlessly switching the lighted nock to the on condition when the lighted nock is desired to be lit.

Many elements of this invention can be designed to minimize noise associated with switching the lighted nock between the off condition and the on condition. Thus, hunters can significantly reduce or eliminate undesirable noises that would scare or chase away the hunted prey.

According to some embodiments of this invention, the lighted nock has a nock body with a shaft extending from the nock body. The nock body can form a nock cavity. A ferrule can form a ferrule cavity. In some embodiments of this invention, a light source, such as an LED structure or another suitable assembly, is housed at least partially within the nock cavity. In some embodiments of this invention, a power source is at least partially housed within the nock cavity and at least partially housed within the ferrule cavity.

In some embodiments of this invention, the nock body is moved with respect to the ferrule to operate the light source between the on condition and the off condition. The shaft of the nock body can be moved between two locked positions in which the first locked position operates the light source in the on condition and the second locked position operates the light source in the off condition. Many different suitable arrangements and designs of components and/or elements of this invention can be moved, positioned and/or otherwise operated to switch or operate the lighted nock between the on condition and the off condition.

In some embodiments of this invention, the ferrule has a body with an extension that attaches or otherwise accommodates a bushing which can be used to easily and quickly adapt the lighted nock assembly of this invention to a shaft, such as a conventional arrow shaft and/or any other suitable shaft.

The battery and/or other power source of this invention can be easily replaced by quickly disassembling and then reassembling the lighted nock assembly, particularly in the field when hunting or engaging in any other sporting event or activity.

BRIEF DESCRIPTION OF THE DRAWINGS

This invention is explained in greater detail below in view of exemplary embodiments shown in the drawings, wherein.

DETAILED DESCRIPTION OF INVENTION

Figure 1:
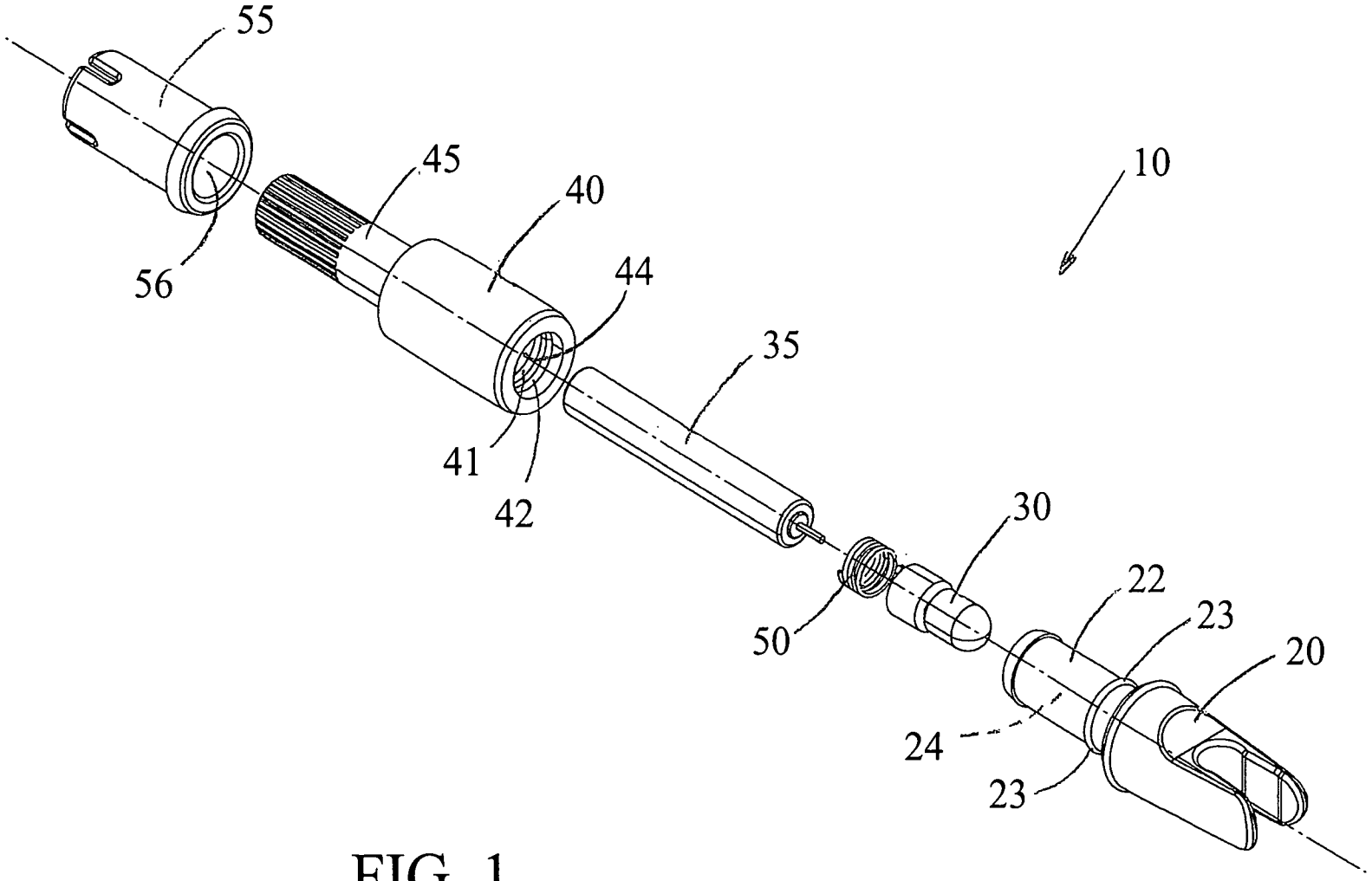
FIG. 1 is an exploded perspective view of a lighted nock assembly, according to one embodiment of this invention.
Figure 2:
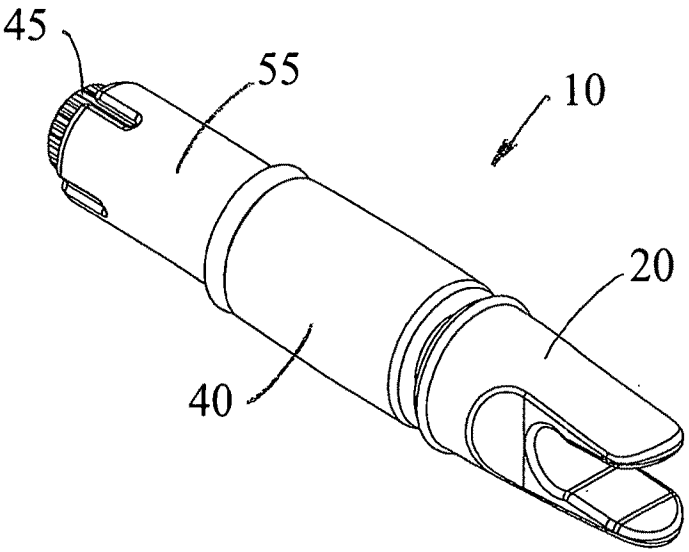
FIG. 2 is a perspective view of a lighted nock assembly, according to one embodiment of this invention.
Figure 5:
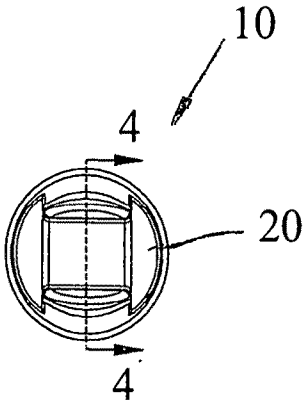
FIG. 5 is a side view of the lighted nock assembly, as shown in FIG. 2.
Figure 4:
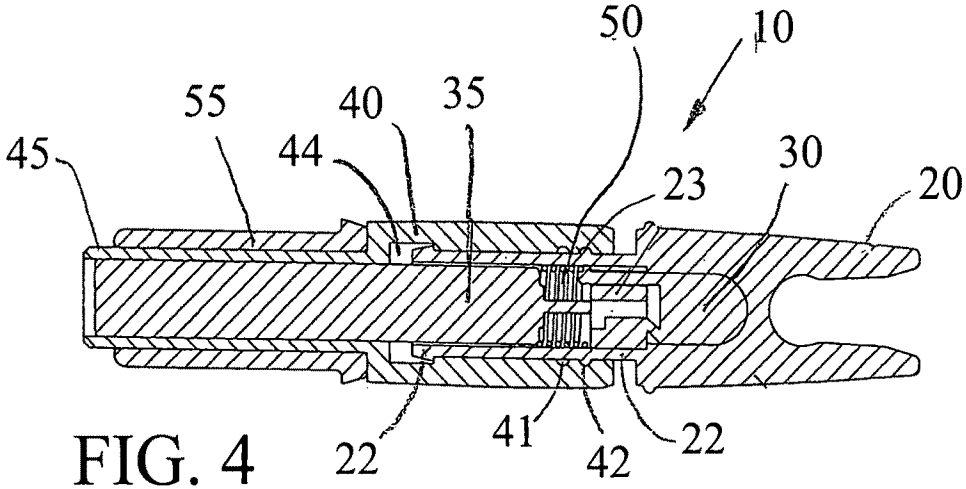
FIG. 4 is a cross-sectional view, taken along line 4-4 as shown in FIG. 5, of the lighted nock assembly as shown in FIG. 2.
Figure 3:
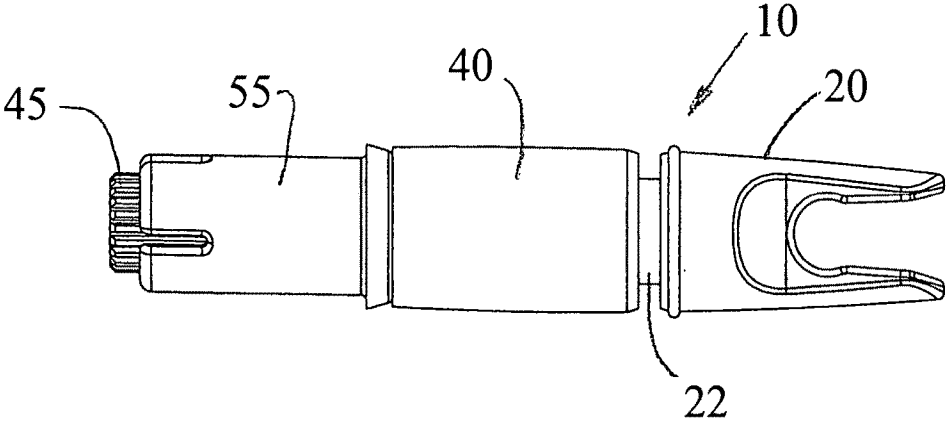
FIG. 3 is a front view of the lighted nock assembly, as shown in FIG. 2.
Figure 6:
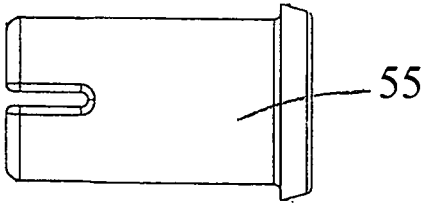
FIG. 6 is a side view of a bushing for a lighted nock assembly, according to one embodiment of this invention.
Figure 8:
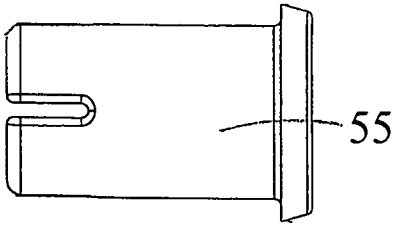
FIG. 8 is a side view of a bushing for a lighted nock assembly, according to one embodiment of this invention.
Figure 10:
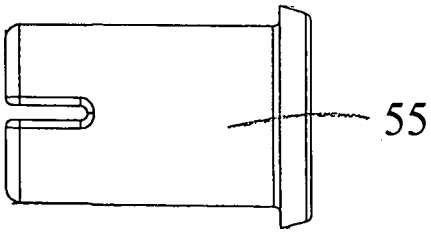
FIG. 10 is a side view of a bushing for a lighted nock assembly, according to one embodiment of this invention.
Figure 7:
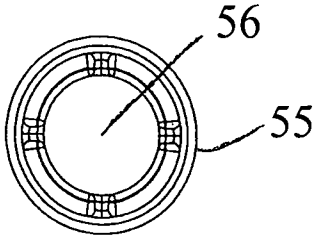
FIG. 7 is a front view of the bushing, as shown in FIG. 6.
Figure 9:
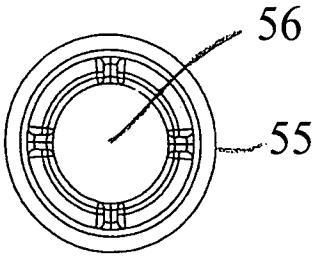
FIG. 9 is a front view of the bushing, as shown in FIG. 8.
Figure 11:
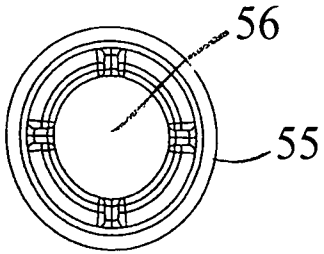
FIG. 11 is a front view of the bushing, as shown in FIG. 10.
Figure 12:
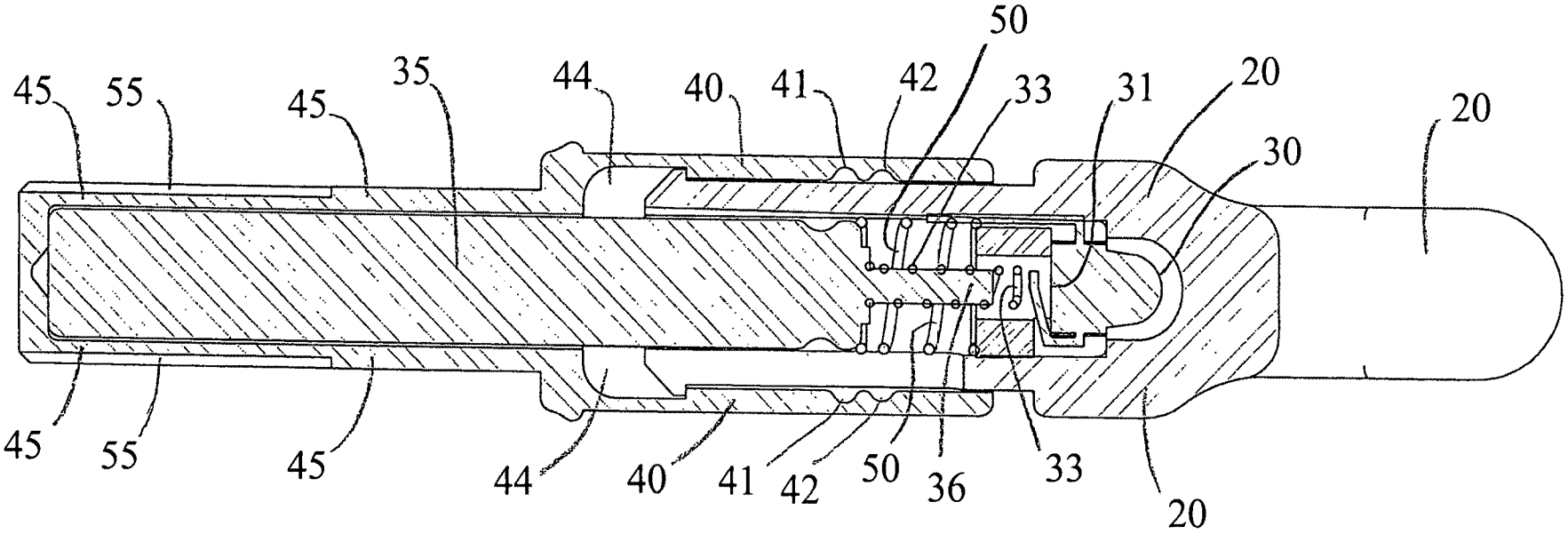
FIG. 12 is a cross-sectional view of an assembly having a light source, a light, two bias elements and a ferrule, according to one embodiment of this invention.

FIG. 1 shows an exploded perspective view of lighted nock 10, according to one embodiment of this invention. FIGS. 2-5 show different views of an assembled lighted nock 10, according to one embodiment of this invention. FIGS. 6-11 show different views of 3 separate embodiments of bushing 55, each as shown in FIGS. 1-4, for example, according to this invention. FIG. 12 shows a cross-sectional view of an assembly or a subassembly comprising light source 30, light element 31, bias element 33, power source 35, ferrule 40 and bias element 50, in an off condition of light source 30, according to one embodiment of this invention.

In some embodiments according to this invention, lighted nock 10 comprises shaft 22 extending from nock body 20, for example, extending and/or directed along a general linear axis, such as a longitudinal axis of nock body 20. In other embodiments of this invention, shaft 22 can have a suitable design, size, shape, layout and/or configuration different from the arrangement shown in FIGS. 1-5. In some embodiments of nock body 20, shaft 22 engages with and/or has a movable and lockable connection with respect to ferrule 40.

According to some embodiments of this invention, nock body 20 has or forms nock cavity 24 which can have any suitable design, shape, size and/or configuration. As shown in FIGS. 1-5, nock cavity 24 is sized, shaped and/or designed to accommodate or house at least a portion of light source 30 and/or at least a portion of bias element 50. In other embodiments according to this invention, nock cavity 24 can be designed to have any other size, shape and/or design technical features that allow any portion or the entire structure of light source 30, bias element 50 and/or power source 35 to be mounted, housed within and/or otherwise positioned or accommodated in a void or other space of the structural portion of nock body 20. In some embodiments of this invention, nock body 20 can have any suitably designed receiver or receiver element, for example to accommodate a line or rope, such as a bow string.

According to some embodiments of this invention, light source 30 is positioned at least partially or entirely within nock cavity 24 and/or housed by or within any other suitable void or space formed by nock body 20. In some embodiments of this invention, light source 30 is positioned completely within nock cavity 24 and in other embodiments of this invention, light source 30 is positioned partially within nock cavity 24. In some embodiments of this invention, light source 30 is mounted, positioned and/or otherwise configured with respect to power source 35 to allow an electrical connection to be formed or not formed and/or switched between an off condition and an on condition of light source 30. Although FIGS. 1-5 and 12 show some embodiments of light source 30, in other embodiments of this invention, light source 30 can be designed, shaped, sized and/or otherwise configured to allow light emitted from light source 30 to pass through and/or be directed through the material forming nock body 20. In some embodiments of this invention, nock body 20 is made of a transparent material, a translucent material and/or any other suitable material that allows at least a portion of light from light 31 and/or light source 30 to pass through or be emitted from nock body 20.

In some embodiments of this invention, light source 30 comprises a light structure, such as an LED light structure, an incandescent light structure and/or any other suitable lighting structure or device that emits light. FIG. 12 shows one embodiment of this invention, with light source 30 in an off condition, which can be formed by having a physical gap between and thus no contact between terminal 36 of power source 35 and light 31. In some embodiments of this invention, light source 30 can be powered to an on condition to light and/or otherwise illuminate the material of nock body 20, for example, to form lighted nock 10 that can be powered on or energized and/or powered off or de-energized. In some embodiments of this invention, light source 30 can have an electrical control or another suitable controller that allows light source 30 to be powered on and powered off, continuously or intermittently, by a control signal.

According to some embodiments of this invention, ferrule 40 forms ferrule cavity 44 which can have any suitable design, shape, size and/or configuration. As shown in FIGS. 1-5, ferrule cavity 44 is sized, shaped and/or designed to accommodate or house at least a portion of power source 35 and/or at least a portion of bias element 50. In other embodiments according to this invention, ferrule cavity 44 can be designed to have any other size, shape and/or design technical feature that allows any portion or the entire structure of power source 35, bias element 50 and/or light source 30 to be mounted, housed within and/or otherwise accommodated in a void or other space of the structural portion or material of ferrule 40.

According to some embodiments of this invention, power source 35 is at least partially housed within, mounted within and/or otherwise positioned within ferrule cavity 44. In different embodiments of this invention, power source 35 can comprise a battery, a rechargeable battery and/or any other suitable power device that can deliver power, particularly to light source 30. In some embodiments of this invention, power source 35 is at least partially housed, mounted and/or otherwise positioned within nock cavity 24. As shown in FIGS. 1-5, power source 35 is housed, mounted and/or otherwise positioned within both nock cavity 24 and ferrule cavity 44. In other embodiments of this invention, other suitable electrical or power elements, designs and/or configurations can be used to form electrical connections necessary to switch to the on condition and the off condition, between power source 35 and light source 30.

According to some embodiments of this invention, shaft 22 of nock body 20 is at least partially mounted within ferrule cavity 44. In some embodiments of this invention, shaft 22 is completely or entirely mounted within ferrule cavity 44. In some embodiments of this invention, shaft 22 is not mounted within ferrule cavity 44 but rather is mounted within a cavity, void and/or space formed by any other suitable structure that allows shaft 22 to engage with and releasably hold a position of shaft 22.

In some embodiments of this invention, nock body 20 can be moved with respect to ferrule 40 to operate light source 30 between the on condition and the off condition. According to different embodiments of this invention, nock body 20 can be moved and/or operated to operate or switch light source 30 between the on condition and the off condition. FIG. 12 shows one embodiment of this invention where light source 30 is in the off condition due to a gap formed between an end surface of terminal 36 of power source 35 and an electrically conducting and mating contact surface of light 31 and/or light source 30.

According to some embodiments of this invention, shaft 22 is movable with respect to ferrule 40 and the movement can be accomplished by shaft 22 having protrusion 23 that matingly engages with inner void 41 and/or inner void 42 of ferrule 40, so that engagement between protrusion 23 and one of inner void 41 and/or inner void 42 forms the on condition of light 31 and/or light source 30 and engagement between protrusion 23 and the other of inner void 41 and/or inner void 42 forms the off condition of light source 30. Thus, shaft 22 can be moved between 2 or more positions to switch or operate light 31 and/or light source 30 between the on condition and the off condition.

In some embodiments according to this invention, in the on condition, protrusion 23 is releasably locked within one of inner void 41 and/or inner void 42, and in the off condition, protrusion 23 is releasably locked within the other of inner void 41 and/or inner void 42. Any other suitable mechanical and/or electromechanical arrangement and/or design of shaft 22, including of protrusion 23 or another similar element, can be used to accomplish the results of switching or operating light 31 and/or light source 30 between the on condition and the off condition. In some embodiments of this invention, movement of nock body 20 with respect to ferrule 40 switches electrical conducting communication from power source 35 to light 31 and/or light source 30 between the on condition and the off condition of light 31 and/or light source 30.

According to some embodiments of this invention, bushing 55 can have bushing cavity 56 and/or any other suitable void, space and/or volume that allows extension 45 of ferrule 40 to be mounted within bushing cavity 56, for example, so that lighted nock 10 can have the overall shape and design as shown in FIGS. 1-5. In some embodiments of this invention, bushing 55 is used to attach, connect and/or otherwise secure lighted nock 10 directly to or with respect to a shaft, such as a conventional arrow shaft or another suitable shaft.

According to some embodiments of this invention, bias element 50 can be positioned, moved and/or operated to urge and/or move light 31 and/or light source 30 with respect to power source 35, so that lighted nock 10 can operate in the on condition or the off condition. In some embodiments of this invention, bias element 50 comprises an electrically conductive spring which can be operated, moved and/or otherwise used to form electrical conducting communication with or between power source 35 and light 31 and/or light source 30 in the on condition, and can also be used to prevent or stop electrical conducting communication between power source 35 and light 31 and/or light source 30 in the off condition of light 31 and/or light source 30.

Any suitable design of bias element 50 can be used to accomplish the result of switching or operating lighted nock 10 between the on condition and the off condition. In some embodiments of this invention, bias element 50 is formed from a material that prevents electricity from flowing through bias element 50 and/or bias element 50 can be formed from any other suitable material that allows lighted nock 10 to be operated between the on condition and the off condition. In other embodiments of this invention, bias element 50 is formed from a material that allows electricity to flow through bias element 50 and/or bias element 50 can be formed from any other suitable material that allows lighted nock 10 to be operated between the on condition and the off condition. For example, bias element 50 can be a coiled spring, such as shown in FIGS. 1 and 12, a leaf spring and/or any other suitable spring or bias device that furnishes or provides a spring force directed at or to light source 30 and/or power source 35. In some embodiments of this invention, bias element 50 is completely mounted within nock cavity 24 of nock body 20. However, bias element 50 can be mounted within any other suitable void, space and/or cavity of another structure.

According to some embodiments of this invention, a method for operating lighted nock 10 includes positioning nock body 20 with respect to ferrule 40, positioning power source 35 within nock cavity 24 of nock body 20 and ferrule cavity 44 of ferrule 40. Light 31 and/or light source 30 can be positioned within nock cavity 24. Bias element 50 can be positioned within nock cavity 24, such as between power source 35 and light source 20. Nock body 20 can be moved with respect to ferrule 40 to operate light source 20 between the on condition and the off condition.

FIG. 12 shows one embodiment of lighted nock 10 in the off condition where electricity does not flow from power source 35 to light source 30. According to one embodiment of this invention, as shown in FIG. 12, preventing electricity from flowing is accomplished by forming a gap or forming no contact between terminal 36 of power source 35 and light source 30. As shown in FIG. 12, power source 35 and light source 30 can be moved closer together or with respect to one another to form contact or electrical communication with or between terminal 36 and light source 30. In other embodiments of this invention, any other suitable mechanical and/or electrical elements and/or systems can be arranged or configured to accomplish the same result of switching electrical communication or conductivity between power source 35 and light source 30 in order to correspondingly switch lighted nock 10 between the on condition and the off condition.

According to some embodiments of this invention, such as shown in FIG. 12, lighted nock 10 comprises or includes both bias element 33 and bias element 50. Bias element 33 can be used to reduce the impact forces on power source 35, terminal 36 and/or light source 30 and thus to reduce wear and tear on such elements. In other embodiments of this invention, bias element 33 can be removed or deleted and still allow bias element 50 to effectively operate lighted nock 10. Although FIG. 12 shows bias element 33 as a coiled spring, any other suitable spring configuration and/or type of bias element can be used to accomplish the same result of forcibly moving power source 35 with respect to light source 30.

While in the foregoing detailed description this invention has been described in relation to certain preferred embodiments, and many details have been set forth for purposes of illustration, it will be apparent to those skilled in the art that this invention is susceptible to additional embodiments and that certain of the details described herein can be varied considerably without departing from the basic principles of and desired results from this invention.

What is claimed is:

1. A lighted nock comprising:

a nock body having a shaft extending from the nock body, the nock body forming a nock cavity, a light source positioned within the nock cavity, a ferrule forming a ferrule cavity and an inwardly extending ferrule ridge, a power source at least partially housed within the ferrule cavity and at least partially housed within the nock cavity, the shaft at least partially mounted within the ferrule cavity, an end portion of the shaft having an outwardly extending protrusion interfering with the inwardly extending ferrule ridge to fix a position of the shaft within the ferrule cavity, and a first bias element and a second bias element mounted between the light source and the power source, wherein movement of the shaft within the ferrule cavity operates the light source between an on condition and an off condition.

2. The lighted nock according to claim 1, wherein movement of the nock body with respect to the ferrule operates the light source between an on condition and an off condition.

3. The lighted nock according to claim 1, wherein the shaft is moveable with respect to the ferrule, and the shaft has a protrusion that matingly engages with a first inner void of the ferrule in an on condition of the light source and with a second inner void of the ferrule in an off condition of the light source.

4. The lighted nock according to claim 3, wherein in the on condition the protrusion of the shaft is releasably locked within the first inner void of the ferrule and in the off condition the protrusion of the shaft is releasably locked within the second inner void of the ferrule.

5. The lighted nock according to claim 1, further comprising a bushing having a bushing cavity and an extension of the ferrule mounted within the bushing cavity.

6. The lighted nock according to claim 1, wherein the first and second bias elements comprise a spring applying a force and forming electrical conducting communication with the power source and the light source when the light source is in an on condition, and the spring releasing the force and preventing electrical conducting communication between the power source and the light source when the light source is in an off condition.

7. The lighted nock according to claim 1, wherein the first and second bias elements normally urge the nock body into a position with respect to the ferrule to form an off condition of the light source that prevents electrical communication between the power source and the light source.

8. The lighted nock according to claim 1, wherein the first and second bias elements are mounted within the nock cavity.

9. The lighted nock according to claim 1, wherein movement of the nock body with respect to the ferrule switches electrical conducting communication from the power source to the light source between an on condition and an off condition of the light source.

10. A lighted nock comprising:

a nock body having a shaft extending from the nock body, the nock body forming a nock cavity, a light source positioned within the nock cavity, a ferrule forming a ferrule cavity, a power source at least partially housed within the ferrule cavity and at least partially housed within the nock cavity, the shaft at least partially mounted within the ferrule cavity, and a first bias element and a second bias element mounted between the light source and the power source, wherein movement of the shaft within the ferrule cavity operates the light source between an on condition and an off condition.

11. The lighted nock according to claim 10, wherein the nock body is moved with respect to the ferrule to operate the light source between an on condition and an off condition.

12. The lighted nock according to claim 10, wherein the shaft is moveable with respect to the ferrule, and the shaft has a protrusion engaging with a first inner void of the ferrule in an on condition of the light source and engaging with a second inner void of the ferrule in an off condition of the light source.

13. The lighted nock according to claim 10, further comprising a bushing having a bushing cavity and a portion of the ferrule housed within the bushing cavity.

14. The lighted nock according to claim 10, wherein the first and second bias elements apply a force between the light source and the power source to electrically connect the power source and the light source when the light source is in an on condition, and to electrically disconnect the power source and the light source when the light source is in an off condition.

15. The lighted nock according to claim 10, wherein the first and second bias elements normally urge the nock body in a direction with respect to the ferrule to form an off condition of the light source.

16. A method for operating a lighted nock, including:

positioning a nock body having a shaft with respect to a ferrule;

positioning a power source within a nock cavity of the nock body and a ferrule cavity of the ferrule;

positioning a light source within the nock cavity;

positioning a first bias element and a second bias element within the nock cavity and between the power source and the light source; and moving the shaft of the nock body within the ferrule cavity to operate the light source between an on condition and an off condition.

17. The method according to claim 16, wherein the nock body has a protrusion engaging with a first inner void of the ferrule in the on condition of the light source and engaging with a second inner void of the ferrule in the off condition of the light source.

18. The method according to claim 17, wherein in the on condition the protrusion is releasably locked within the first inner void of the ferrule and in the off condition the protrusion is releasably locked within the second inner void of the ferrule.

19. The method according to claim 16, wherein a bushing has a bushing cavity and an extension of the ferrule is mounted within the bushing cavity.

20. The lighted nock method according to claim 16, wherein the first and second bias elements are a spring forming electrical conducting communication with the power source and the light source when the light source is in the on condition, and the spring preventing electrical conducting communication with the power source and the light source when the light source is in the off condition.

* * * * *